US008642240B2

(12) United States Patent
Araki

(10) Patent No.: US 8,642,240 B2
(45) Date of Patent: Feb. 4, 2014

(54) ELECTROPHOTOGRAPHIC TONER

(71) Applicants: Kabushiki Kaisha Toshiba, Tokyo (JP); Toshiba Tec Kabushiki Kaisha, Tokyo (JP)

(72) Inventor: Satoshi Araki, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/776,846

(22) Filed: Feb. 26, 2013

(65) Prior Publication Data

US 2013/0183616 A1 Jul. 18, 2013

Related U.S. Application Data

(63) Continuation of application No. 12/951,165, filed on Nov. 22, 2010, now Pat. No. 8,404,420.

(60) Provisional application No. 61/263,494, filed on Nov. 23, 2009.

(51) Int. Cl.
*G03G 9/08* (2006.01)

(52) U.S. Cl.
USPC ..... 430/111.4; 430/108.1; 430/137.14

(58) Field of Classification Search
USPC ..... 430/111.4, 108.1, 137.14; 399/252
See application file for complete search history.

(56) References Cited

U.S. PATENT DOCUMENTS

| | | | | |
|---|---|---|---|---|
| 6,203,603 | B1 | 3/2001 | Takayana et al. | |
| 8,404,420 | B2 * | 3/2013 | Araki | 430/111.4 |
| 2009/0087767 | A1 | 4/2009 | Nakamura | |
| 2010/0209839 | A1 | 8/2010 | Kabai et al. | |
| 2011/0014558 | A1 | 1/2011 | Ikuta et al. | |

FOREIGN PATENT DOCUMENTS

| | | | |
|---|---|---|---|
| EP | 0542286 | A1 | 5/1993 |
| EP | 1041447 | A1 | 10/2000 |
| JP | 2000-056497 | | 2/2000 |
| JP | 2005-345862 | | 12/2005 |
| JP | 2007-279329 | | 10/2007 |

OTHER PUBLICATIONS

Extended European Search Report for Application No. 10191752.4-1217 dated Mar. 14, 2011.
Japanese Office Action for Japanese Application No. 2010-261686 dated Oct. 30, 2012.

* cited by examiner

*Primary Examiner* — Mark A Chapman
(74) *Attorney, Agent, or Firm* — Turocy & Watson, LLP

(57) ABSTRACT

A decolorable electrophotographic toner, containing a color former compound, a color developing agent, a binder resin, and a release agent, wherein the toner has a pH of from 6 to 9 when dispersed in water with a pH of from 5.5 to 7 at a mass ratio of toner/water of 1/10.

16 Claims, 3 Drawing Sheets

FIG.3

| | D50 (μm) | DISPERSION PH OF TONER | RESIDUAL AMOUNT OF METAL SALT (%) | IMAGE DENSITY OF COLOR DEVELOPED IMAGE | DECOLORIZING PROPERTY | RATIO OF CHARGE AMOUNT HH/LL (%) |
|---|---|---|---|---|---|---|
| EXAMPLE 1 | 9.8 | 6.5 | 0.3 | 0.7 | ○ | 75 |
| EXAMPLE 2 | 8.5 | 6.9 | 0 | 0.8 | ○ | 79 |
| EXAMPLE 3 | 10.1 | 7.5 | 0.8 | 0.8 | ○ | 67 |
| EXAMPLE 4 | 9.8 | 6.2 | 0.1 | 1.0 | ○ | 82 |
| EXAMPLE 5 | 9.8 | 8.7 | 0.8 | 0.7 | ○ | 51 |
| COMPARATIVE EXAMPLE 1 | 9.8 | 9.2 | 0.9 | 0.2 | ○ | 32 |
| COMPARATIVE EXAMPLE 2 | 12.1 | 5.7 | 1.8 | 0.6 | × | 67 |

ELECTROPHOTOGRAPHIC TONER

CROSS-REFERENCE TO RELATED APPLICATIONS

This application is a Continuation of application Ser. No. 12/951,165 filed on Nov. 22, 2010, which is based upon and claims the benefit of priority from U.S. provisional application 61/263494, filed on Nov. 23, 2009; the entire contents of both of which are incorporated herein by reference.

FIELD

Embodiments described herein relate to a technique for an electrophotographic toner capable of erasing an image formed on a recording medium by a decolorization operation.

BACKGROUND

As a method for producing a toner, which contains a color former compound, a color developing agent, and optionally a decolorizing agent and is capable of erasing an image formed on a recording medium by decolorization (erasing the color), a kneading pulverization method is usually adopted. The kneading pulverization method is a method for producing desired toner particles by melt-kneading a binder resin, a color former compound, a color developing agent, a release agent such as a wax, a charge control agent, and the like, cooling the resulting kneaded material, finely pulverizing the cooled material, and then, classifying the resulting fine particles.

However, although the reduction in the particle diameter of a toner is demanded for achieving a high-quality image, there is a limit to the reduction in the particle diameter by a kneading pulverization method.

DESCRIPTION OF THE DRAWINGS

FIG. 3 is a table showing the properties of toners of Examples.

DETAILED DESCRIPTION

A decolorable toner according to this embodiment contains a color former compound, a color developing agent, a binder resin, and a release agent, and has a pH at 25° C. of from 6 to 9 when dispersed in water with a pH of from 5.5 to 7 at a mass ratio of toner/water of 1/10.

Hereinafter, embodiments will be described with reference to the drawings.

Conventionally, a decolorable toner is produced by a kneading pulverization method. However, there is a limit to the reduction in the particle diameter of the toner by a kneading pulverization method.

Therefore, the present inventors conceived a method for producing a toner through a step of aggregating and fusing a color former compound and a color developing agent, and a binder resin in a dispersion medium as one example.

On the other hand, in the aggregation, a monovalent or polyvalent acidic metal salt (hereinafter, also simply referred to as "metal salt") such as magnesium sulfate or aluminum sulfate can be used as an aggregating agent. Further, in order to control the aggregation and fusion rate, a pH adjusting agent or a surfactant can also be added to the dispersion medium.

In this case, however, due to the effect of the acidic metal salt or the acidic component of the pH adjusting agent which was used in the aggregation and fusion step and remained in the toner, there was a case where the image could not be sufficiently erased, and there was also a case where the surfactant remaining in the toner deteriorated the environmental variability of the toner.

Figure 1:
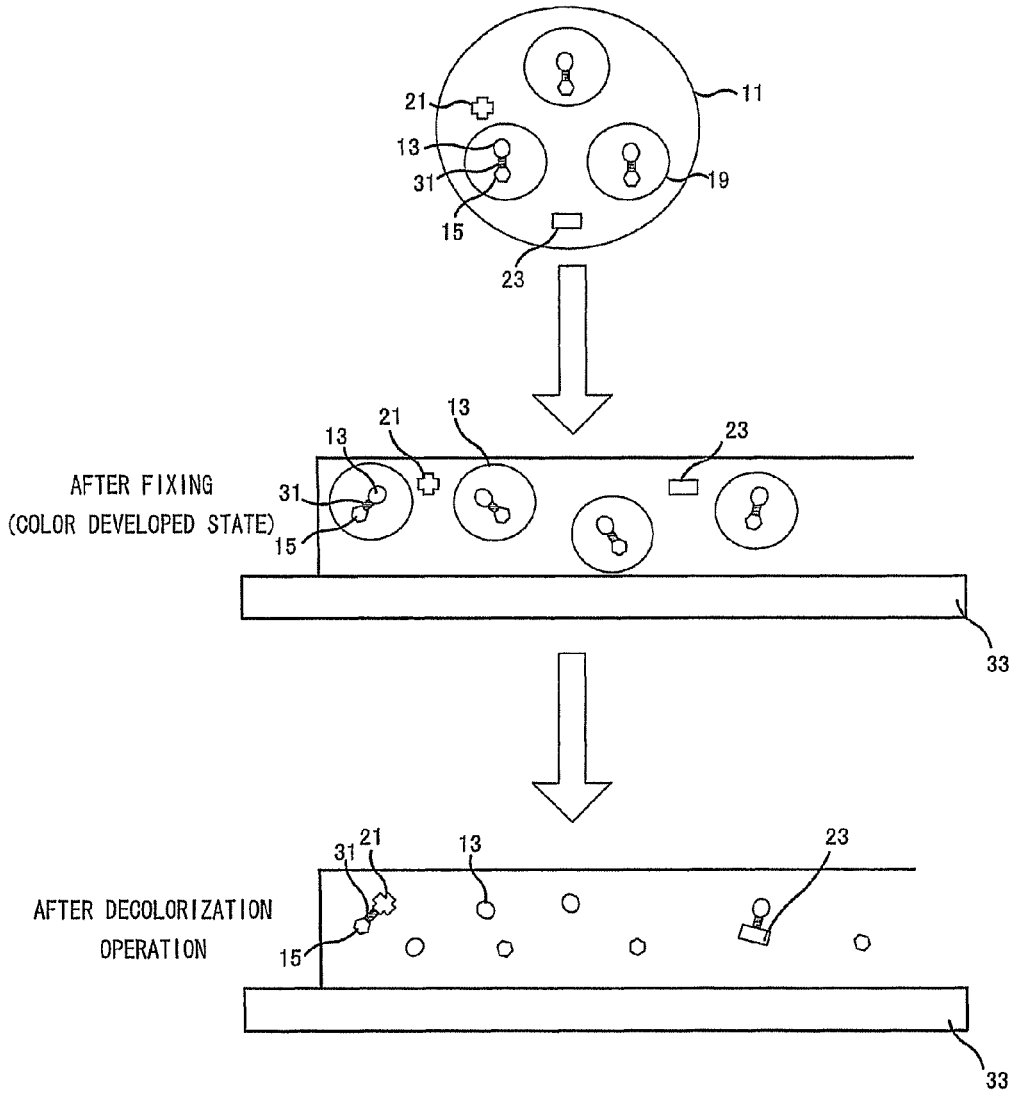
FIG. 1 is a schematic view for illustrating an effect of a residual pH adjusting agent or acidic metal salt.

The effect of the metal salt or the pH adjusting agent will be specifically described with reference to FIG. 1. In FIG. 1, the numeral 11 denotes a decolorable toner, the numeral 13 denotes a color developing agent, and the numeral 15 denotes a color former compound. Further, the numeral 19 denotes a fine particle resulting from the encapsulation of the color developing agent 13 and the color former compound 15. Further, the numeral 21 denotes a pH adjusting agent and the numeral 23 denotes a metal salt. Further, the numeral 31 denotes a bond, and the numeral 33 denotes a base material.

As shown in FIG. 1, the toner 11 containing the fine particles 19 resulting from the encapsulation of the color developing agent 13 and the color former compound 15 is fixed and an image is formed on the base material 33. At this time, the color developing agent 13 and the color former compound 15 are bound to each other and the color former compound is in a color developed state.

Further, when a decolorization operation is performed by heating the base material 33, the color developing agent 13 and the color former compound 15 are dissociated from each other, and the color is erased, whereby the image can be erased.

However, when the metal salt 23 or the pH adjusting agent 21 remained in the toner, the metal salt 23 or the pH adjusting agent 21 reacted with part of the color former compound 15 during the decolorization operation, and the part of the color former compound 15 was maintained in the color developed state in some cases. As a result, even when the decolorization operation was performed, the image could not be sufficiently erased in some cases.

Accordingly, as a result of intensive studies made by the present inventors, it was found that by controlling the pH of a toner at 25° C. when the toner is dispersed in water with a pH of from 5.5 to 7 at a mass ratio of toner/water of 1/10 (hereinafter also simply referred to as "dispersion pH") to 6 to 9, the binding between the color former compound and the metal salt or the pH adjusting agent remaining in the toner can be inhibited during the decolorization operation, and also the surfactant remaining in the toner can be inhibited, and therefore, a toner which is capable of sufficiently erasing the image and has favorable environmental variability can be obtained. Incidentally, it is preferred that the dispersion pH is from 6 to 7.5.

If the dispersion pH of the toner is less than 6, the reaction between the leuco dye and the acidic metal salt during the decolorization operation cannot be inhibited as compared with the case where the dispersion pH is within the above range. Therefore, the image density cannot be decreased as compared with the case where the dispersion pH is within the above range.

Meanwhile, the dispersion pH of the toner is more than 9, the hygroscopicity is increased as compared with the case where the dispersion pH is within the above range, and therefore, the environmental variability of the toner is markedly increased. As a result, for example, when an image is formed using this toner, the formed image may be unclear in some cases.

Further, in the toner according to this embodiment, as the aggregating agent, an acidic metal salt can be used. At this time, the upper limit of the content of the acidic metal salt is preferably 1% by mass based on the total mass of the toner. By controlling the content of the acidic metal salt in the toner to 1% by mass or less, the image density after the decolorization treatment can be further decreased. Further, if the content of the acidic metal salt exceeds 1% by mass, the melt viscosity of the toner when fixing is increased and also the toner resistance is decreased to deteriorate the charging property as compared with the case where the content is within the above range, and therefore, the content is preferably 1% by mass or less.

Incidentally, in this embodiment, the "acidic metal salt" refers to a metal salt showing an acidic pH when dissolved in water. Specific examples of the acidic metal salt include metal salts formed by the combination of a strong acid with a weak base such as sodium sulfate, disodium hydrogen phosphate, magnesium sulfate, and aluminum sulfate. Such a metal salt is used as the aggregating agent in, for example the aggregation and fusion step, and is mainly mixed in the toner in, for example, the aggregation and fusion step.

Incidentally, the lower limit of the content of the metal salt is not particularly limited, however, it can be set to, for example, 0. That is, the toner according to this embodiment can be configured to contain practically no metal salt.

First, the configuration of the toner according to this embodiment will be described.

The toner according to this embodiment contains a coloring agent, a binder resin, and a release agent. In this specification, the coloring agent refers to one kind of compound or a composition that imparts a color to the toner. In this embodiment, the coloring agent contains a color former compound and a color developing agent.

The color former compound is an electron donating compound which accepts a proton from the color developing agent when binding thereto. In this embodiment, the color former compound is not particularly limited and can be appropriately determined by a person skilled in the art, however, for example, a leuco dye can be used. Examples of the leuco dye include diphenylmethane phthalides, phenylindolyl phthalides, indolyl phthalides, diphenylmethane azaphthalides, phenylindolyl azaphthalides, fluorans, styrynoquinolines, and diaza-rhodamine lactones.

Specific examples thereof include 3,3-bis(p-dimethylaminophenyl)-6-dimethylaminophthalide, 3-(4-diethylaminophenyl)-3-(1-ethyl-2-methylindol-3-yl)phthalide, 3,3-bis(1-n-butyl-2-methylindol-3-yl)phthalide, 3,3-bis(2-ethoxy-4-diethylaminophenyl)-4-azaphthalide, 3-(2-ethoxy-4-diethylaminophenyl)-3-(1-ethyl-2-methylindol-3-yl)-4-azaphthalide, 3-[2-ethoxy-4-(N-ethylanilino)phenyl]-3-(1-ethyl-2-methylindol-3-yl)-4-azaphthalide, 3,6-diphenylaminofluoran, 3,6-dimethoxyfluoran, 3,6-di-n-butoxyfluoran, 2-methyl-6-(N-ethyl-N-p-tolylamino)fluoran, 2-N,N-dibenzylamino-6-diethylaminofluoran, 3-chloro-6-cyclohexylaminofluoran, 2-methyl-6-cyclohexylaminofluoran, 2-(2-chloroanilino)-6-di-n-butylaminofluoran, 2-(3-trifluoromethylanilino)-6-diethylaminofluoran, 2-(N-methylanilino)-6-(N-ethyl-N-p-tolylamino)fluoran, 1,3-dimethyl-6-diethylaminofluoran, 2-chloro-3-methyl-6-diethylaminofluoran, 2-anilino-3-methyl-6-diethylaminofluoran, 2-anilino-3-methyl-6-di-n-butylaminofluoran, 2-xylidino-3-methyl-6-diethylaminofluoran, 1,2-benz-6-diethylaminofluoran, 1,2-benz-6-(N-ethyl-N-isobutylamino)fluoran, 1,2-benz-6-(N-ethyl-N-isoamylamino)fluoran, 2-(3-methoxy-4-dodecoxystyryl)quinoline, spiro[5H-(1)benzopyrano(2,3-d)pyrimidine-5,1'(3'H)isobenzofuran]-3'-one, 2-(diethylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-methyl-, spiro[5H-(1)benzopyrano(2,3-d)pyrimidine-5,1'(3'H)isobenzofuran]-3'-one, 2-(di-n-butylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(N-ethyl-N-i-amylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-phenyl, 3-(2-methoxy-4-dimethylaminophenyl)-3-(1-butyl-2-methylindol-3-yl)-4,5,6,7-tetrachlorophthalide, 3-(2-ethoxy-4-diethylaminophenyl)-3-(1-ethyl-2-methylindol-3-yl)-4,5,6,7-tetrachlorophthalide, and 3-(2-ethoxy-4-diethylaminophenyl)-3-(1-pentyl-2-methylindol-3-yl)-4,5,6,7-tetrachlorophthalide. Additional examples thereof include pyridine compounds, quinazoline compounds, and bisquinazoline compounds. These compounds may be used by mixing two or more of them.

The color developing agent to be used in this embodiment is an electron accepting compound which donates a proton to the color former compound such as a leuco dye. Examples thereof include phenols, metal salts of phenols, metal salts of carboxylic acids, aromatic carboxylic acids, aliphatic carboxylic acids having 2 to 5 carbon atoms, benzophenones, sulfonic acids, sulfonates, phosphoric acids, metal salts of phosphoric acids, acidic phosphoric acid esters, metal salts of acidic phosphoric acid esters, phosphorous acids, metal salts of phosphorous acids, monophenols, polyphenols, 1,2,3-triazole, and derivatives thereof. Additional examples thereof include those having, as a substituent, an alkyl group, an aryl group, an acyl group, an alkoxycarbonyl group, a carboxy group or an ester thereof, an amide group, a halogen group, or the like, and bisphenols, trisphenols, phenol-aldehyde condensed resins, and metal salts thereof. These compounds may be used by mixing two or more of them.

Specific examples thereof include phenol, o-cresol, tertiary butyl catechol, nonylphenol, n-octylphenol, n-dodecylphenol, n-stearylphenol, p-chlorophenol, p-bromophenol, o-phenylphenol, n-butyl p-hydroxybenzoate, n-octyl p-hydroxybenzoate, benzyl p-hydroxybenzoate, dihydroxybenzoic acid or esters thereof such as methyl 2,3-dihydroxybenzoate and methyl 3,5-dihydroxybenzoate, resorcin, gallic acid, dodecyl gallate, ethyl gallate, butyl gallate, propyl gallate, 2,2-bis(4-hydroxyphenyl)propane, 4,4-dihydroxydiphenylsulfone, 1,1-bis(4-hydroxyphenyl)ethane, 2,2-bis(4-hydroxy-3-methylphenyl)propane, bis(4-hydroxyphenyl)sulfide, 1-phenyl-1,1-bis(4-hydroxyphenyl)ethane, 1,1-bis(4-hydroxyphenyl)-3-methylbutane, 1,1-bis(4-hydroxyphenyl)-2-methylpropane, 1,1-bis(4-hydroxyphenyl)-n-hexane, 1,1-bis(4-hydroxyphenyl)-n-heptane, 1,1-bis(4-hydroxyphenyl)-n-octane, 1,1-bis(4-hydroxyphenyl)-n-nonane, 1,1-bis(4-hydroxyphenyl)-n-decane, 1,1-bis(4-hydroxyphenyl)-n-dodecane, 2,2-bis(4-hydroxyphenyl)butane, 2,2-bis(4-hydroxyphenyl)ethyl propionate, 2,2-bis(4-hydroxyphenyl)-4-methylpentane, 2,2-bis(4-hydroxyphenyl)hexafluoropropane, 2,2-bis(4-hydroxyphenyl)-n-heptane 2,2-bis(4-hydroxyphenyl)-n-nonane, 2,4-dihydroxyacetophenone, 2,5-dihydroxyacetophenone, 2,6-dihydroxyacetophenone, 3,5-dihydroxyacetophenone, 2,3,4-trihydroxyacetophenone, 2,4-dihydroxybenzophenone, 4,4'-dihydroxybenzophenone, 2,3,4-trihydroxybenzophenone, 2,4,4'-trihydroxybenzophenone, 2,2',4,4'-tetrahydroxybenzophenone, 2,3,4,4'-tetrahydroxybenzophenone, 2,4'-biphenol, 4,4'-biphenol, 4-[(4-hydroxyphenyl)methyl]-1,2,3-benzenetriol, 4-[(3,5-dimethyl-4-hydroxyphenyl)methyl]-1,2,3-benzenetriol, 4,6-bis[(3,5-dimethyl-4-hydroxyphenyl) methyl]-1,2,3-benzenetriol, 4,4'-[1,4-phenylenebis(1-methylethylidene)bis(benzene-1,2,3-triol)], 4,4'-[1,4-phenylenebis(1-methylethylidene)bis(1,2-benzenediol)], 4,4',4"-ethylidenetrisphenol, 4,4'-(1-methylethylidene) bisphenol, and methylenetris-p-cresol.

The binder resin constituting the toner according to this embodiment is not particularly limited and can be appropriately determined by a person skilled in the art.

As the binder resin, for example, a polyester resin obtained by subjecting a dicarboxylic acid component and a diol component to an esterification reaction followed by polycondensation, or a polystyrene resin can be used.

Among these components, examples of the dicarboxylic acid component include aromatic dicarboxylic acids such as terephthalic acid, phthalic acid, and isophthalic acid; and aliphatic carboxylic acids such as fumaric acid, maleic acid, succinic acid, adipic acid, sebacic acid, glutaric acid, pimelic acid, oxalic acid, malonic acid, citraconic acid, and itaconic acid.

Further, examples of the diol component include aliphatic diols such as ethylene glycol, propylene glycol, 1,4-butanediol, 1,3-butanediol, 1,5-pentanediol, 1,6-hexanediol, neopentyl glycol, trimethylene glycol, trimethylolpropane, and pentaerythritol; alicyclic diols such as 1,4-cyclohexanediol and 1,4-cyclohexanedimethanol; and an ethylene oxide or propylene oxide adduct of bisphenol A or the like.

Further, the above polyester component may be converted so as to have a crosslinking structure using a trivalent or higher polyvalent carboxylic acid component or a trihydric or higher polyhydric alcohol component such as 1,2,4-benzenetricarboxylic acid (trimellitic acid) or glycerin.

In the toner according to this embodiment, two or more kinds of polyester resins having different compositions may be mixed and used.

Further, in the toner according to this embodiment, the polyester resin may be crystalline or noncrystalline.

Further, as the polystyrene resin, a polystyrene resin obtained by copolymerization of an aromatic vinyl component and a (meth)acrylic acid ester component is preferred. Examples of the aromatic vinyl component include styrene, α-methylstyrene, o-methylstyrene, and p-chlorostyrene. Examples of the acrylic acid ester component include ethyl acrylate, propyl acrylate, butyl acrylate, 2-ethylhexyl acrylate, butyl methacrylate, ethyl methacrylate, and methyl methacrylate. Among these, butyl acrylate is generally used. As the polymerization method, an emulsion polymerization method is generally employed, and the resin is obtained by radical polymerization of monomers of the respective components in an aqueous phase containing an emulsifying agent.

The glass transition temperatures of the polyester resin and the polystyrene resin are preferably 30° C. or higher and 55° C. or lower. If the glass transition temperature is lower than 30° C., an unnatural gloss appears after decolorization in a region where the toner is placed, and also the storage stability of the toner is deteriorated. Meanwhile, if the glass transition temperature is higher than 55° C., the low-temperature fixability cannot be obtained.

The weight average molecular weight Mw of the polyester resin is preferably 5000 or more and 30000 or less. On the other hand, the weight average molecular weight Mw of the polystyrene resin is preferably 10000 or more and 70000 or less. If the weight average molecular weight Mw of the polyester resin is less than 5000 (in the case of the polystyrene resin, less than 10000), the heat-resistant storage stability of the toner is deteriorated as compared with the case where the weight average molecular weight Mw is in the above range. Meanwhile, if the weight average molecular weight Mw of the polyester resin is more than 30000 (in the case of the polystyrene resin, more than 70000), the fixing temperature is increased as compared with the case where the weight average molecular weight Mw is in the above range, and therefore, it is not preferred from the viewpoint of suppression of power consumption in the fixation treatment.

The release agent to be contained in the toner is not particularly limited. Examples thereof include aliphatic hydrocarbon waxes such as low-molecular weight polyethylenes, low-molecular weight polypropylenes, polyolefin copolymers, polyolefin waxes, microcrystalline waxes, paraffin waxes, and Fischer-Tropsch waxes; oxides of aliphatic hydrocarbon waxes such as polyethylene oxide waxes or block copolymers thereof; vegetable waxes such as candelilla wax, carnauba wax, Japan wax, jojoba wax, and rice wax; animal waxes such as bees wax, lanolin, and whale wax; mineral waxes such as ozokerite, ceresin, and petrolatum; waxes containing, as a main component, a fatty acid ester such as montanic acid ester wax and castor wax; and deoxidation products resulting from deoxidation of a part or the whole of a fatty acid ester such as deoxidized carnauba wax. Further, saturated linear fatty acids such as palmitic acid, stearic acid, montanic acid, and long-chain alkyl carboxylic acids having a longer chain alkyl group; unsaturated fatty acids such as brassidic acid, eleostearic acid, and parinaric acid; saturated alcohols such as stearyl alcohol, eicosyl alcohol, behenyl alcohol, carnaubyl alcohol, ceryl alcohol, melissyl alcohol, and long-chain alkyl alcohols having a longer chain alkyl group; polyhydric alcohols such as sorbitol; fatty acid amides such as linoleic acid amide, oleic acid amide, and lauric acid amide; saturated fatty acid bisamides such as methylenebisstearic acid amide, ethylenebiscaprylic acid amide, ethylenebislauric acid amide, and hexamethylenebisstearic acid amide; unsaturated fatty acid amides such as ethylenebisoleic acid amide, hexamethylenebisoleic acid amide, N,N'-dioleyladipic acid amide, and N,N'-dioleylsebacic acid amide; aromatic bisamides such as m-xylenebisstearic acid amide, and N,N'-distearylisophthalic acid amide; fatty acid metal salts (generally called metallic soaps) such as calcium stearate, calcium laurate, zinc stearate, and magnesium stearate; waxes obtained by grafting of a vinyl monomer such as styrene or acrylic acid on an aliphatic hydrocarbon wax; partially esterified products of a fatty acid and a polyhydric alcohol such as behenic acid monoglyceride, and methyl ester compounds having a hydroxyl group obtained by hydrogenation of a vegetable fat or oil can be exemplified.

In the toner according to this embodiment, other components such as a decolorizing agent, a charge control agent, and an external additive may be contained or retained on the outer surface thereof.

The decolorizing agent is a substance which is preferentially compatible with the color developing agent and therefore has an action of reducing the interaction between the color former compound and the color developing agent to effect decolorization, and a known substance can be used in this embodiment. The toner according to this embodiment can be decolorized by heating even if the toner does not contain a decolorizing agent, however, by incorporating the decolorizing agent, a decolorization treatment can be more promptly performed.

The decolorizing agent can be, for example, incorporated in the below-mentioned fine particles resulting from the encapsulation of the color former compound and the color developing agent.

As the charge control agent, a metal-containing azo compound is used, and the metal element is preferably a complex or a complex salt of iron, cobalt, or chromium, or a mixture thereof. Further, as the charge control agent, a metal-containing salicylic acid derivative compound can also be used. In the case of using such a metal-containing salicylic acid derivative compound, the metal element is preferably a complex or a complex salt of zirconium, zinc, chromium, or boron, or a mixture thereof. By incorporating the charge control agent, a frictional charge quantity can be controlled.

Further, as the external additive, for example, in order to adjust the fluidity or chargeability, inorganic fine particles can be externally added and mixed in an amount of from 0.01 to 20% by mass based on the total mass of the toner particles. As such inorganic fine particles, silica, titania, alumina, strontium titanate, tin oxide, and the like can be used alone or by mixing two or more of them. It is preferred that as the inorganic fine particles, those surface-treated with a hydrophobizing agent are used from the viewpoint of improvement of environmental stability. Further, other than such inorganic oxides, resin fine particles having a size of 1 μm or less may be externally added for improving the cleaning property.

Incidentally, the contents of the respective components constituting the toner are not particularly limited and can be appropriately determined by a person skilled in the art.

Figure 2:
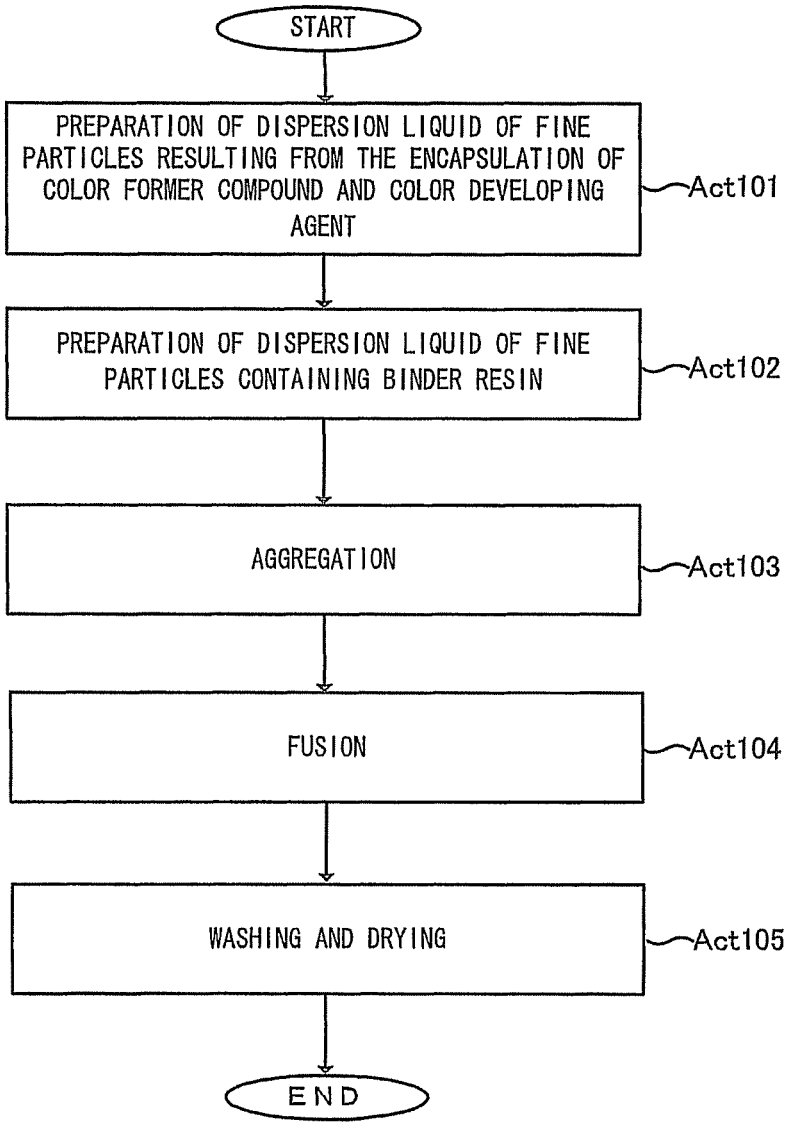
FIG. 2 is a process flow chart of one example of a method for producing an electrophotographic toner according to an embodiment.

Subsequently, steps in the method for producing a toner according to this embodiment will be described as an example with reference to the flow chart shown in FIG. 2.

First, in Act 101, a dispersion liquid of fine particles resulting from the encapsulation of a color former compound and a color developing agent (hereinafter, also referred to as "first dispersion liquid") is prepared.

The preparation can be performed by dispersing fine particles prepared according to a known microencapsulation method in a dispersion medium such as water. Specific examples of the method which can be adopted include a coacervation method, an interfacial polymerization method, an in situ polymerization method, and a spray drying method. More specifically, the preparation can be performed according to the method described in, for example, JP-A-60-264285.

Prior to the preparation of the first dispersion liquid, the color former compound and the color developing agent are bound to each other in advance by heating so that the color former compound is converted to a color developed state, whereby a coloring agent can be formed. The coloring agent can be formed according to a known method.

Subsequently, in Act 102, a dispersion liquid of fine particles containing a binder resin and a release agent (hereinafter, also referred to as "second dispersion liquid") is prepared. The second dispersion liquid can be obtained by, for example, forming fine particles by a mechanical emulsification method through mechanical shearing using a polyester resin and a release agent in a dispersion medium. Further, as another embodiment, a dispersion liquid in which emulsion polymerized fine particles of a styrene acrylic resin or the like and a release agent are dispersed, or a dispersion liquid containing a release agent and particles obtained by depositing a binder resin dissolved in an organic solvent through a phase inversion emulsification method or the like can be used.

Subsequently, the first dispersion liquid and the second dispersion liquid are mixed, and the fine particles resulting from the encapsulation of the color former compound and the color developing agent and the fine particles containing the binder resin and the release agent are subjected to an aggregation treatment (Act 103). Thereafter, the aggregated fine particles are subjected to a fusion treatment (Act 104).

In Act 103, first, the first dispersion liquid and the second dispersion liquid are mixed, and then, an aggregating agent is added to the resulting mixture while heating and stirring the mixture. Subsequently, the mixed dispersion liquid was further heated to effect the aggregation treatment. The kind of the aggregating agent and the addition amount thereof can be appropriately determined by a person skilled in the art according to the kinds of the color former compound, color developing agent, binder resin, and other components, the dispersion stability of the fine particles subjected to the aggregation treatment in the dispersion liquid, the particle diameter of the aggregated particles obtained after fusing, and the like. Further, the heating temperature in the aggregation treatment can also be appropriately determined by a person skilled in the art according to the kinds of the color former compound, color developing agent, binder resin, and other components.

As the aggregating agent, for example, a monovalent metal salt such as sodium chloride, potassium chloride, lithium chloride, or sodium sulfate; a divalent metal salt such as magnesium chloride, calcium chloride, magnesium sulfate, calcium nitrate, zinc chloride, ferric chloride, or ferric sulfate; or a trivalent metal salt such as aluminum sulfate or aluminum chloride can be used.

Subsequently, in Act 104, the aggregated fine particles are fused by increasing the fluidity of the binder resin through heating.

The heating temperature in the fusion treatment can be determined according to the kind of the binder resin to be used (specifically, the glass transition temperature Tg of the binder resin to be used). More specifically, the heating temperature can be appropriately determined in a range from the glass transition temperature of the binder resin to the decolorization initiation temperature (a temperature at which the color former compound and the color developing agent bound to each other are dissociated from each other to initiate decolorization).

Incidentally, when another component such as a decolorizing agent is incorporated, such a component may be mixed, for example, in the step of preparing the fine particles resulting from the encapsulation of the color former compound and the color developing agent or the step of aggregation treatment.

Further, aggregation and fusion may sometimes be performed simultaneously according to the kind of the binder resin, the concentration of the solid content, or the kind of the aggregating agent.

Further, for example, in order to accelerate the progression of aggregation and fusion or to control the shape of particles formed by fusion (also referred to as fused particles), a pH adjusting agent or a surfactant can be added.

As one example of the aggregation and fusion treatment, the first dispersion liquid and the second dispersion liquid are mixed, and the mixed dispersion liquid is heated to a temperature of 40° C. Subsequently, while stirring the mixed dispersion liquid, aluminum sulfate as the aggregating agent is added thereto. Then, while stirring the mixed dispersion liquid, the temperature of the mixed dispersion liquid is gradually raised to 80° C. and the mixed dispersion liquid is maintained at the temperature, whereby fused particles are obtained. The particle diameter of the fused particles can be set to, for example, 10 μm.

Incidentally, in this embodiment, the release agent is incorporated in the fine particles containing the binder resin, however, the invention is not limited thereto. For example, the release agent may be added to the mixed dispersion liquid in the aggregation step of Act 103, thereby incorporating the release agent in the toner to be produced.

Subsequently, in Act 105, the obtained fused particles are washed and dried, whereby a toner is produced. To the produced toner, an external additive is externally added as needed.

In this embodiment, an apparatus for use in washing is not particularly limited, however, for example, a centrifugal separator, a filter press, or the like is preferably used. Further, as the washing liquid, for example, water, ion exchanged water, purified water, water adjusted to acidic pH, water adjusted to basic pH, or the like can be used.

In the washing step, by repeating washing and filtration, a water-containing cake is obtained. Here, the washing is performed until the pH of the filtrate when washing (hereinafter also referred to as "washing filtrate") at 25° C. becomes 6 to 9. This can make the dispersion pH of the obtained toner fall within the range from 6 to 9. Further, the upper limit of the electrical conductivity of the washing filtrate at this time is preferably 10 μS/cm at 25° C. Incidentally, the lower limit of the electrical conductivity is not particularly limited, however, it can be set to, for example, 0.05 μS/cm in consideration of the washing water to be used for washing.

The obtained water-containing cake is dried until the water content becomes about 1% by mass by a given drying method such as a flash dryer, a vibration dryer, or an oven, whereby a dried material is obtained. The dried material is then crushed by a given method, whereby a toner is formed. The formed toner can be subjected to an external addition treatment using silica, titanium oxide, or the like.

Incidentally, in this embodiment, the color former compound and the color developing agent are encapsulated, however, the invention is not limited thereto.

The toner according to this embodiment is mixed with a carrier in the same manner as a common toner and is prepared as a developer. The thus prepared developer is placed in, for example, an image forming apparatus such as multifunction peripheral (MFP) and is used for forming an image on a recording medium.

In the image formation step, as a result of heating a toner image formed using the toner according to this embodiment and transferred onto a recording medium at a fixing temperature, the resin is melted and penetrates into the recording medium, and thereafter, the resin is solidified, thereby forming an image on the recording medium (fixation treatment).

Further, the image formed on the recording medium can be erased by performing a decolorization treatment for the toner. Specifically, the decolorization treatment can be performed by heating the recording medium on which the image is formed at a heating temperature not lower than the decolorization initiation temperature so as to dissociate the color former compound and the color developing agent bound to each other from each other.

EXAMPLES

Subsequently, the toner according to this embodiment will be described in more detail with reference to the following Examples. However, the invention is by no means limited to the following Examples.

Example 1

1. Preparation of First Dispersion Liquid

Components composed of 1 part by mass of 3-(2-ethoxy-4-diethylaminophenyl)-3-(1-ethyl-2-methylindol-3-yl)-4-azaphthalide as a leuco dye, 5 parts by mass of 2,2-bis(4-hydroxyphenyl)hexafluoropropane as a color developing agent, and 50 parts by mass of a diester compound of pimelic acid and 2-(4-benzyloxyphenyl)ethanol as a decolorizing agent were dissolved by heating, and further, 20 parts by mass of an aromatic polyvalent isocyanate prepolymer and 40 parts by mass of ethyl acetate as encapsulating agents were mixed therein, and the resulting solution was poured into 250 parts by mass of a 8% aqueous solution of polyvinyl alcohol. Then, the resulting mixture was emulsified and dispersed, and the resulting dispersion was continuously stirred at 90° C. for about 1 hour. Thereafter, 2 parts by mass of a water-soluble aliphatic modified amine as a reaction agent was added thereto, and the resulting dispersion was kept at a liquid temperature of 90° C. and continuously stirred for about 3 hours, whereby colorless encapsulated particles were obtained. Then, this encapsulated particle dispersion was placed in a freezer to develop a color, whereby a dispersion of blue color developed particles was obtained. The volume average particle diameter of the thus obtained color developed particles was measured using SALD-7000 (manufactured by Shimadzu Corporation) and found to be 2 μm. Incidentally, the complete decolorization temperature Th was 79° C., and the complete color development temperature Tc was −10° C.

2. Preparation of Dispersion Liquid of Fine Particles Containing Binder Resin

94 Parts by mass of a polyester resin (glass transition temperature: 45° C., softening point: 100° C.) as a binder resin, 5 parts by mass of rice wax as a release agent, and 1 part by mass of TN-105 (manufactured by Hodogaya Chemical Co., Ltd.) as a charge control agent were uniformly mixed using a dry mixer, and the resulting mixture was melt-kneaded at 80° C. using PCM-45 (manufactured by Ikegai Iron Works Ltd.) which is a twin-screw kneader. The resulting toner composition was crushed to 2 mm mesh pass using a pin mill, and further crushed to an average particle diameter of 50 μm using a Bantam mill.

Subsequently, 0.9 parts by mass of sodium dodecylbenzene sulfonate as a surfactant, 0.45 parts by mass of dimethyl aminoethanol as a pH adjusting agent, and 68.65 parts by mass of ion exchanged water were mixed to obtain an aqueous solution, and 30 parts by mass of the crushed toner composition was dispersed in the aqueous solution, followed by vacuum defoaming, whereby a dispersion liquid was obtained.

Subsequently, the dispersion liquid was subjected to a pulverization treatment at 180° C. and 150 MPa using NANO 3000 (manufactured by Beryu Co., Ltd.) provided with a high-pressure pipe for heat exchange having a length of 12 m immersed in an oil bath as a heating unit, a high-pressure pipe having nozzles having diameters of 0.13 μm and 0.28 μm, respectively, arranged in a row therein as a pressure applying unit, a medium-pressure pipe having cells having pore diameters of 0.4, 1.0, 0.75, 1.5, and 1.0 μm, respectively, arranged in a row therein as a pressure reducing unit, and a heat exchange pipe having a length of 12 m capable of cooling with tap water as a cooling unit. After the pressure was reduced while maintaining the temperature at 180° C., the dispersion liquid was cooled to 30° C., whereby a dispersion of toner component particles was obtained. The volume average particle diameter of the thus obtained particles was measured using SALD-7000 (manufactured by Shimadzu Corporation) and found to be 0.5 μm.

3. Aggregation and Fusion Step 1.7 Parts by mass of the dispersion of color developed particles, 15 parts by mass of the dispersion of toner component particles, and 83 parts by mass of ion exchanged water were mixed, and 5 parts by mass of a 5% aqueous solution of aluminum sulfate was added to the resulting mixture while stirring the mixture at 6500 rpm using a homogenizer (manufactured by IKA Japan K.K.). Then, the temperature of the mixture was raised to 40° C. while stirring the mixture at 800 rpm in a 1 L stirring vessel equipped with a paddle blade. After the mixture was left as such at 40° C. for 1 hour, 10 parts by mass of a 10% aqueous solution of sodium polycarboxylate was added thereto, and the resulting mixture was heated to 68° C. and left as such for 1 hour. Then, the mixture was cooled, whereby a blue toner dispersion liquid C was obtained.

4. Washing, Drying, and External Addition Treatment Step

This toner dispersion liquid C was filtered and washed with ion exchanged water in an amount of 1670 parts by mass in total. The electrical conductivity of the filtrate after completion of washing was 8 μS/cm (measured by using electrical conductivity meter ES-51 manufactured by Horiba, Ltd., hereinafter the same shall apply). Further, the pH of the washing filtrate at 25° C. was 6.8 (the same temperature condition shall apply to the other Examples and Comparative Examples). Thereafter, the washed toner was dried using a vacuum dryer until the water content became 1.0% by mass or less, whereby dried particles were obtained.

After drying, as additives, 2 parts by mass of hydrophobic silica and 0.5 parts by mass of titanium oxide were adhered to the surfaces of the toner particles, whereby a decolorable toner was obtained. The particle diameter of the thus obtained toner was measured using Multisizer 3 (manufactured by Beckman Coulter, Inc.) and it was found that the 50% volume average particle diameter Dv was 9.8 μm. Further, the dispersion pH of the obtained toner was measured and found to be 6.5. Incidentally, the content of the metal salt in the toner was 0.3%.

5. Evaluation

The obtained toner was mixed with a ferrite carrier coated with a silicone resin, and an image was output using a MFP (e-studio 4520c) manufactured by Toshiba Tec Corporation. The temperature of the fixing device was set to 70° C., the paper feed rate was adjusted to 30 mm/sec, and a paper on which a color developed image having an image density of 0.7 was formed was obtained.

The obtained paper having an image formed thereon was conveyed at a paper feed rate of 200 mm/sec by setting the temperature of the fixing device to 150° C., and it was confirmed that a clearly erased image was obtained.

Further, the obtained toner was mixed with a ferrite carrier coated with a silicone resin under an LL environment (temperature: 10° C., humidity: 20%, hereinafter the same shall apply) and an HH environment (temperature: 30° C., humidity: 80%, hereinafter the same shall apply), and the charge amount thereof was measured for both conditions, respectively. As a result, the ratio of the charge amount HH/LL was 75%. The ratio of the charge amount HH/LL is preferably 50% or more, more preferably 65% or more. If the ratio of the charge amount HH/LL is less than 50%, the environmental dependence of the toner is large, and the amount of development under the LL environment cannot be controlled or toner scattering under the HH environment occurs.

Example 2

1.7 Parts by mass of the dispersion of color developed particles, 15 parts by mass of the dispersion of toner component particles, and 83 parts by mass of ion exchanged water were mixed, and 10 parts by mass of a 0.5% aqueous solution of hydrochloric acid was added to the resulting mixture while stirring the mixture at 6500 rpm using a homogenizer (manufactured by IKA Japan K.K.). Then, the temperature of the mixture was raised to 40° C. while stirring the mixture at 800 rpm in a 1 L stirring vessel equipped with a paddle blade. After the mixture was left as such at 40° C. for 1 hour, 10 parts by mass of a 5% aqueous solution of dimethyl aminoethanol was added thereto, and the resulting mixture was heated to 70° C. and left as such for 1 hour. Then, the mixture was cooled, whereby a blue toner dispersion liquid was obtained.

Subsequently, this toner dispersion liquid was filtered and washed with ion exchanged water in an amount of 1000 parts by mass in total. The electrical conductivity of the filtrate after completion of washing was 7 μS/cm. Further, the pH of the washing filtrate was 7.5. Thereafter, the washed toner was dried using a vacuum dryer until the water content became 1.0% by mass or less, whereby dried particles were obtained.

After drying, as additives, 2 parts by mass of hydrophobic silica and 0.5 parts by mass of titanium oxide were adhered to the surfaces of the toner particles, whereby a decolorable toner was obtained. The particle diameter of the thus obtained toner was measured using Multisizer 3 (manufactured by Beckman Coulter, Inc.) and it was found that the 50% volume average particle diameter Dv was 8.5 μm. Further, the dispersion pH of the obtained toner was measured and found to be 6.9. Incidentally, the content of the metal salt in the toner was 0%.

The obtained toner was mixed with a ferrite carrier coated with a silicone resin, and an image was output using a MFP (e-studio 4520c) manufactured by Toshiba Tec Corporation. The temperature of the fixing device was set to 70° C., the paper feed rate was adjusted to 30 mm/sec, and a paper on which a color developed image having an image density of 0.8 was formed was obtained.

The obtained paper having an image formed thereon was conveyed at a paper feed rate of 200 mm/sec by setting the temperature of the fixing device to 150° C., and it was confirmed that a clearly erased image was obtained.

Further, the obtained toner was mixed with a ferrite carrier coated with a silicone resin under the LL environment and the HH environment, and the charge amount thereof was measured for both conditions, respectively. As a result, the ratio of the charge amount HH/LL was 79%.

Example 3

1.7 Parts by mass of the dispersion of color developed particles, 15 parts by mass of the dispersion of toner component particles, and 83 parts by mass of ion exchanged water were mixed, and 5 parts by mass of a 5% aqueous solution of aluminum sulfate was added to the resulting mixture while stirring the mixture at 6500 rpm using a homogenizer (manufactured by IKA Japan K.K.). Then, the temperature of the mixture was raised to 40° C. while stirring the mixture at 800 rpm in a 1 L stirring vessel equipped with a paddle blade. After the mixture was left as such at 40° C. for 1 hour, 10 parts by mass of a 5% aqueous solution of dimethyl aminoethanol was added thereto, and the resulting mixture was heated to 68° C. and left as such for 1 hour. Then, the mixture was cooled, whereby a blue toner dispersion liquid was obtained.

Subsequently, this toner dispersion liquid was filtered and washed with ion exchanged water in an amount of 1000 parts by mass in total. The electrical conductivity of the filtrate after completion of washing was 15 μS/cm. Further, the pH of the washing filtrate was 7.7. Thereafter, the washed toner was dried using a vacuum dryer until the water content became 1.0% by mass or less, whereby dried particles were obtained.

After drying, as additives, 2 parts by mass of hydrophobic silica and 0.5 parts by mass of titanium oxide were adhered to the surfaces of the toner particles, whereby a decolorable toner was obtained. The particle diameter of the thus obtained toner was measured using Multisizer 3 (manufactured by Beckman Coulter, Inc.) and it was found that the 50% volume average particle diameter Dv was 10.1 μm. Further, the dispersion pH of the obtained toner was measured and found to be 7.5. Incidentally, the content of the metal salt in the toner was 0.8%.

The obtained toner was mixed with a ferrite carrier coated with a silicone resin, and an image was output using a MFP (e-studio 4520c) manufactured by Toshiba Tec Corporation. The temperature of the fixing device was set to 70° C., the paper feed rate was adjusted to 30 mm/sec, and a paper on which a color developed image having an image density of 0.8 was formed was obtained.

The obtained paper having an image formed thereon was conveyed at a paper feed rate of 200 mm/sec by setting the temperature of the fixing device to 150° C., and it was confirmed that a clearly erased image was obtained.

Further, the obtained toner was mixed with a ferrite carrier coated with a silicone resin under the LL environment and the HH environment, and the charge amount thereof was measured for both conditions, respectively. As a result, the ratio of the charge amount HH/LL was 67%.

Example 4

A toner was produced in the same manner as in Example 1 except that washing with ion exchanged water in an amount of 3000 parts by mass was performed. At this time, the electrical conductivity of the filtrate after completion of washing was 1 μS/cm. Further, the pH of the washing filtrate was 6.2. Thereafter, the washed toner was dried using a vacuum dryer until the water content became 1.0% by mass or less, whereby dried particles were obtained.

After drying, as additives, 2 parts by mass of hydrophobic silica and 0.5 parts by mass of titanium oxide were adhered to the surfaces of the toner particles, whereby a decolorable toner was obtained. The particle diameter of the thus obtained toner was measured using Multisizer 3 (manufactured by Beckman Coulter, Inc.) and it was found that the 50% volume average particle diameter Dv was 9.8 μm. Further, the dispersion pH of the obtained toner was measured and found to be 6.3. Incidentally, the content of the metal salt in the toner was 0.1%.

The obtained toner was mixed with a ferrite carrier coated with a silicone resin, and an image was output using a MFP (e-studio 4520c) manufactured by Toshiba Tec Corporation. The temperature of the fixing device was set to 70° C., the paper feed rate was adjusted to 30 mm/sec, and a paper on which a color developed image having an image density of 1.0 was formed was obtained.

The obtained paper having an image formed thereon was conveyed at a paper feed rate of 200 mm/sec by setting the temperature of the fixing device to 150° C., and it was confirmed that a clearly erased image was obtained.

Further, the obtained toner was mixed with a ferrite carrier coated with a silicone resin under the LL environment and the HH environment, and the charge amount thereof was measured for both conditions, respectively. As a result, the ratio of the charge amount HH/LL was 82%.

Example 5

A toner was produced in the same manner as in Example 1 except that washing with ion exchanged water in an amount of 500 parts by mass was performed. The electrical conductivity of the filtrate after completion of washing was 17 μS/cm. Further, the pH of the washing filtrate was 8.9. After drying, as additives, 2 parts by mass of hydrophobic silica and 0.5 parts by mass of titanium oxide were adhered to the surfaces of the toner particles, whereby a decolorable toner was obtained. The particle diameter of the thus obtained toner was measured using Multisizer 3 (manufactured by Beckman Coulter, Inc.) and it was found that the 50% volume average particle diameter Dv was 9.8 μm. Further, the dispersion pH of the obtained toner was measured and found to be 8.7. Incidentally, the content of the metal salt in the toner was 0.8%.

The obtained toner was mixed with a ferrite carrier coated with a silicone resin, and an image was output using a MFP (e-studio 4520c) manufactured by Toshiba Tec Corporation. The temperature of the fixing device was set to 70° C., the paper feed rate was adjusted to 30 mm/sec, and a paper on which a color developed image having an image density of 0.7 was formed was obtained.

The obtained paper having an image formed thereon was conveyed at a paper feed rate of 200 mm/sec by setting the temperature of the fixing device to 150° C., and it was confirmed that a clearly erased image was obtained.

Further, the obtained toner was mixed with a ferrite carrier coated with a silicone resin under the LL environment and the HH environment, and the charge amount thereof was measured for both conditions, respectively. As a result, the ratio of the charge amount HH/LL was 51%.

Comparative Example 1

A toner was produced in the same manner as in Example 1 except that the toner dispersion liquid was filtered and washed with ion exchanged water in an amount of 167 parts by mass in total. The electrical conductivity of the filtrate after completion of washing was 32 μS/cm. Further, the pH of the washing filtrate was 9.8.

After drying, as additives, 2 parts by mass of hydrophobic silica and 0.5 parts by mass of titanium oxide were adhered to the surfaces of the toner particles, whereby a decolorable toner was obtained. The particle diameter of the thus obtained toner was measured using Multisizer 3 (manufactured by Beckman Coulter, Inc.) and it was found that the 50% volume average particle diameter Dv was 9.8 μm. Further, the dispersion pH of the obtained toner was measured and found to be 9.2. Incidentally, the content of the metal salt in the toner was 0.9%.

The obtained toner was mixed with a ferrite carrier coated with a silicone resin, and an image was output using a MFP (e-studio 4520c) manufactured by Toshiba Tec Corporation. The temperature of the fixing device was set to 70° C., the paper feed rate was adjusted to 30 mm/sec, and a paper on which an unclear image having an image density of 0.2 was formed was obtained.

The obtained paper having an image formed thereon was conveyed at a paper feed rate of 200 mm/sec by setting the temperature of the fixing device to 150° C., and it was confirmed that a clearly erased image was obtained.

Further, the obtained toner was mixed with a ferrite carrier coated with a silicone resin under the LL environment and the HH environment, and the charge amount thereof was measured for both conditions, respectively. As a result, the ratio of the charge amount HH/LL was 32%.

Comparative Example 2

1.7 Parts by mass of the dispersion of color developed particles, 15 parts by mass of the dispersion of toner component particles, and 83 parts by mass of ion exchanged water were mixed, and 5 parts by mass of a 10% aqueous solution of aluminum sulfate was added to the resulting mixture while stirring the mixture at 6500 rpm using a homogenizer (manufactured by IKA Japan K.K.). Then, the temperature of the mixture was raised to 40° C. while stirring the mixture at 800 rpm in a 1 L stirring vessel equipped with a paddle blade. After the mixture was left as such at 40° C. for 1 hour, 10 parts by mass of a 10% aqueous solution of sodium polycarboxylate was added thereto, and the resulting mixture was heated to 68° C. and left as such for 1 hour. Then, the mixture was cooled, whereby a blue toner dispersion liquid was obtained.

Subsequently, this toner dispersion liquid was filtered and washed with ion exchanged water in an amount of 1670 parts by mass in total. The electrical conductivity of the filtrate after completion of washing was 14 μS/cm. Further, the pH of the washing filtrate was 6.0. Thereafter, the washed toner was dried using a vacuum dryer until the water content became 1.0% by mass or less, whereby dried particles were obtained.

After drying, as additives, 2 parts by mass of hydrophobic silica and 0.5 parts by mass of titanium oxide were adhered to the surfaces of the toner particles, whereby a decolorable toner was obtained. The particle diameter of the thus obtained toner was measured using Multisizer 3 (manufactured by Beckman Coulter, Inc.) and it was found that the 50% volume average particle diameter Dv was 12.1 μm. Further, the dispersion pH of the obtained toner was measured and found to be 5.7. Incidentally, the content of the metal salt in the toner was 1.8%.

The obtained toner was mixed with a ferrite carrier coated with a silicone resin, and an image was output using a MFP (e-studio 4520c) manufactured by Toshiba Tec Corporation. The temperature of the fixing device was set to 70° C., the paper feed rate was adjusted to 30 mm/sec, and a paper on which a color developed image having an image density of 0.6 was formed was obtained.

The obtained paper having an image formed thereon was conveyed at a paper feed rate of 200 mm/sec by setting the temperature of the fixing device to 150° C., however, partly colored regions remained on the paper and the erasure of the image was incomplete.

Further, the obtained toner was mixed with a ferrite carrier coated with a silicone resin under the LL environment and the HH environment, and the charge amount thereof was measured for both conditions, respectively. As a result, the ratio of the charge amount HH/LL was 67%.

Incidentally, the dispersion pH was determined as follows. To the toner, pure water with a pH of from 5.5 to 7 was added at a mass ratio of toner/pure water of 1/10, and the resulting mixture was subjected to a dispersion treatment for 10 minutes using an ultrasonic disperser. Then, the resulting dispersion liquid was filtered, and the pH of the filtrate was measured.

Further, the content of aluminum sulfate was determined as follows. First, a powder containing the toner materials and a known concentration of aluminum sulfate was molded using a press-molding machine, and a calibration curve was created by a fluorescent X-ray analysis. Subsequently, each of the toners prepared in the respective Examples was molded into a pellet by a press-molding machine and the resulting pellet was subjected to a fluorescent X-ray analysis. Then, the content of aluminum sulfate in the toner was calculated from the calibration curve.

The color developing property was evaluated based on the image density obtained using a Macbeth densitometer.

The decolorizing property was evaluated by visual observation.

From FIG. 3, it can be found that all of the toners of Examples having a dispersion pH of from 6 to 9 can decrease the image density through the decolorization operation as compared with the toners of Comparative Examples. Further, by controlling the content of the acidic metal salt to 1% by mass or less, the image density when the decolorization treatment is performed can be further decreased. In addition, by controlling the dispersion pH to 6 to 7.5, the environmental variability can be made favorable and also the image density when the decolorization treatment is performed can be decreased.

While certain embodiments have been described, these embodiments have been presented by way of example only, and are not intended to limit the scope of invention. Indeed, the novel method described herein may be embodied in a variety of other forms; furthermore, various omissions, substitutions and changes in the form of the compound described herein may be made without departing from the spirit of the inventions. The accompanying claims and their equivalents are intended to cover such forms or modifications as would fall within the scope and spirit of the inventions.

As described in detail in the above, according to the technique described in this specification, a toner capable of decreasing the image density by a decolorization operation can be provided.

What is claimed is:

1. A decolorable electrophotographic toner, being produced by aggregating and fusing a particle which includes a color former compound and a color developing agent, a binder resin, and a release agent with use of an aggregating agent and having a pH at 25° C. of from 6 to 9 when dispersed in water with a pH of from 5.5 to 7 at a mass ratio of toner/water of 1/10.

2. The toner according to claim 1, wherein the toner has a pH at 25° C. of from 6 to 7.5 when dispersed in water with a pH of from 5.5 to 7 at a mass ratio of toner/water of 1/10.

3. The toner according to claim 2, wherein the upper limit of the content of the aggregating agent contained in the toner is 1% by mass.

4. The toner according to claim 2, wherein the aggregating agent is an acidic metal salt and the upper limit of the content of the acidic metal salt contained in the toner is 1% by mass.

5. The toner according to claim 4, wherein the toner is produced by washing a particle obtained by the aggregation and the fusion until the pH of a filtrate at 25° C. becomes 6 to 9.

6. The toner according to claim 5, wherein the toner is produced by washing until the electrical conductivity of the filtrate becomes 10 μS/cm or less.

7. The toner according to claim 2, wherein the color former compound and the color developing agent are included in a particle having a capsule structure coated with an outer shell.

8. The toner according to claim 7, wherein the particle having a capsule structure coated with an outer shell further includes a decolorizing agent.

9. The toner according to claim 1, wherein the upper limit of the content of the aggregating agent contained in the toner is 1% by mass.

10. The toner according to claim 1, wherein the aggregating agent is an acidic metal salt and the upper limit of the content of the acidic metal salt contained in the toner is 1% by mass.

11. The toner according to claim 10, wherein the toner is produced by washing a particle obtained by the aggregation and the fusion until the pH of a filtrate at 25° C. becomes 6 to 9.

12. The toner according to claim 11, wherein the toner is produced by washing until the electrical conductivity of the filtrate becomes 10 μS/cm or less.

13. The toner according to claim 1, wherein the color former compound and the color developing agent are included in a particle having a capsule structure coated with an outer shell.

14. The toner according to claim 13, wherein the particle having a capsule structure coated with an outer shell further includes a decolorizing agent.

15. A toner container comprising the toner according to claim 1.

16. An image forming apparatus comprising the toner according to claim 1.

* * * * *